US008898964B1

(12) United States Patent
Francies, III

(10) Patent No.: US 8,898,964 B1
(45) Date of Patent: Dec. 2, 2014

(54) LIFT ANCHOR ASSEMBLY FOR PRECAST PORTLAND CEMENT CONCRETE SHAPES

(71) Applicant: Sidney E. Francies, III, Lithia, FL (US)

(72) Inventor: Sidney E. Francies, III, Lithia, FL (US)

(73) Assignee: A.L. Patterson, Inc., Fairless Hills, PA (US)

( * ) Notice: Subject to any disclaimer, the term of this patent is extended or adjusted under 35 U.S.C. 154(b) by 0 days.

(21) Appl. No.: 14/039,184

(22) Filed: Sep. 27, 2013

Related U.S. Application Data

(60) Provisional application No. 61/706,282, filed on Sep. 27, 2012.

(51) Int. Cl.
*E02D 35/00* (2006.01)
*E04G 21/14* (2006.01)
*E04B 1/41* (2006.01)

(52) U.S. Cl.
CPC ..... *E04G 21/142* (2013.01); *E04B 1/41* (2013.01)
USPC ..... 52/125.4; 52/125.3; 52/125.5; 52/122.1

(58) Field of Classification Search
CPC ... E04G 21/142; E04G 21/145; E04G 21/147; B66C 1/666; E04B 1/41
USPC ..... 52/122.1, 124.2, 125.1–125.5
See application file for complete search history.

(56) References Cited

U.S. PATENT DOCUMENTS

| | | | | |
|---|---|---|---|---|
| 4,627,198 | A * | 12/1986 | Francies, III | 52/125.5 |
| 6,729,079 | B2 * | 5/2004 | Francies et al. | 52/125.4 |
| 6,769,663 | B2 * | 8/2004 | Kelly et al. | 249/91 |
| 2009/0205268 | A1 * | 8/2009 | Fletcher | 52/125.4 |
| 2009/0320386 | A1 * | 12/2009 | Mackay Sim | 52/125.4 |

* cited by examiner

*Primary Examiner* — Charles A Fox
*Assistant Examiner* — Patrick Maestri
(74) *Attorney, Agent, or Firm* — McGarry Bair PC

(57) ABSTRACT

A lift anchor assembly is characterized by a lift anchor defining a longitudinal axis, a bilaterally symmetrical lift plate, an opening through the lift plate bisected by the longitudinal axis, a bilaterally symmetrical embedment portion spaced away from and coupled with the lift plate, and a pair of elongate legs, each coupled with the embedment portion and with the lift plate parallel to the longitudinal axis. A recess insert is characterized by a pair of pivotably coupled concave insert shells defining a chamber and a longitudinal plane of symmetry. An elongate rod-like shear bar is characterized by a U-shaped bend. The recess insert is engageable with the lift anchor by coupling the insert shells on either side of the lift anchor through the opening. The shear bar is engageable with the lift anchor and recess insert by positioning the U-shaped bend over the lift plate and the opening.

12 Claims, 12 Drawing Sheets

LIFT ANCHOR ASSEMBLY FOR PRECAST PORTLAND CEMENT CONCRETE SHAPES

CROSS-REFERENCE TO RELATED APPLICATION

This application claims the benefit of U.S. provisional application Ser. No. 61/706,282, filed Sep. 27, 2012, which is incorporated by reference herein in its entirety.

BACKGROUND OF THE INVENTION

The present invention relates generally to erection anchors and recess inserts for concrete structural components. In particular, the invention relates to an integrated erection anchor and recess insert that can be assembled, utilized during placement of fresh concrete to provide a recess for access to the erection anchor, and readily separated leaving the erection anchor embedded in the concrete and the recess insert removable for use in subsequent concrete placements.

DESCRIPTION OF THE RELATED ART

It is known to produce concrete structural components for buildings, bridges, marine structures, utilities, and the like. Concrete structural components may be pre-cast at a manufacturing plant followed by shipping and installation at a construction site. The use of lifting cranes, large transport vehicles, and other heavy equipment may be necessary to accommodate the size and weight of these components.

Metal erection anchors are frequently installed in fresh concrete to facilitate the attachment of hooks, cables, and chains used in moving large concrete components. Once the concrete cures, the components can be lifted by cables and hooks attached to the erection anchors, and set in place.

That part of the erection anchor to which hooks, cables, and chains may be attached must remain accessible after the concrete has cured. Fresh concrete must therefore be prevented from contacting this part of the erection anchor. An insert is frequently utilized to form a cavity into which the upper part of the erection anchor extends, which is open to the adjacent finished concrete surface. Once the concrete has cured sufficiently, the insert may be separated from the anchor and removed from the cavity.

However, known inserts may suffer from various shortcomings. For example, known inserts may be readily dislodged during the placement of concrete, resulting in cavities that are ill-formed, which may restrict the attachment and performance of lifting apparatuses to the erection anchor. Known inserts may fail to adequately seal against an influx of water and concrete, thereby necessitating frequent removal of water and concrete, or disposal of otherwise reusable inserts. Water retained inside inserts may cause rust formation on the erection anchors, which must be removed. Cleaning of the inserts and erection anchors may add significantly to the time, labor, and costs of manufacturing concrete components.

BRIEF DESCRIPTION OF THE INVENTION

A lift anchor assembly is characterized by a lift anchor defining a longitudinal axis, a bilaterally symmetrical lift plate, an opening through the lift plate bisected by the longitudinal axis, a bilaterally symmetrical embedment portion spaced away from and coupled with the lift plate, and a pair of elongate legs, each coupled with the embedment portion and with the lift plate parallel to the longitudinal axis. A recess insert is characterized by a pair of pivotably coupled concave insert shells defining a chamber and a longitudinal plane of symmetry. An elongate rod-like shear bar is characterized by a U-shaped bend. The recess insert is engageable with the lift anchor by coupling the insert shells on either side of the lift anchor through the opening. The shear bar is engageable with the lift anchor and recess insert by positioning the U-shaped bend over the lift plate and the opening.

DESCRIPTION OF AN EMBODIMENT OF THE INVENTION

Figure 1:
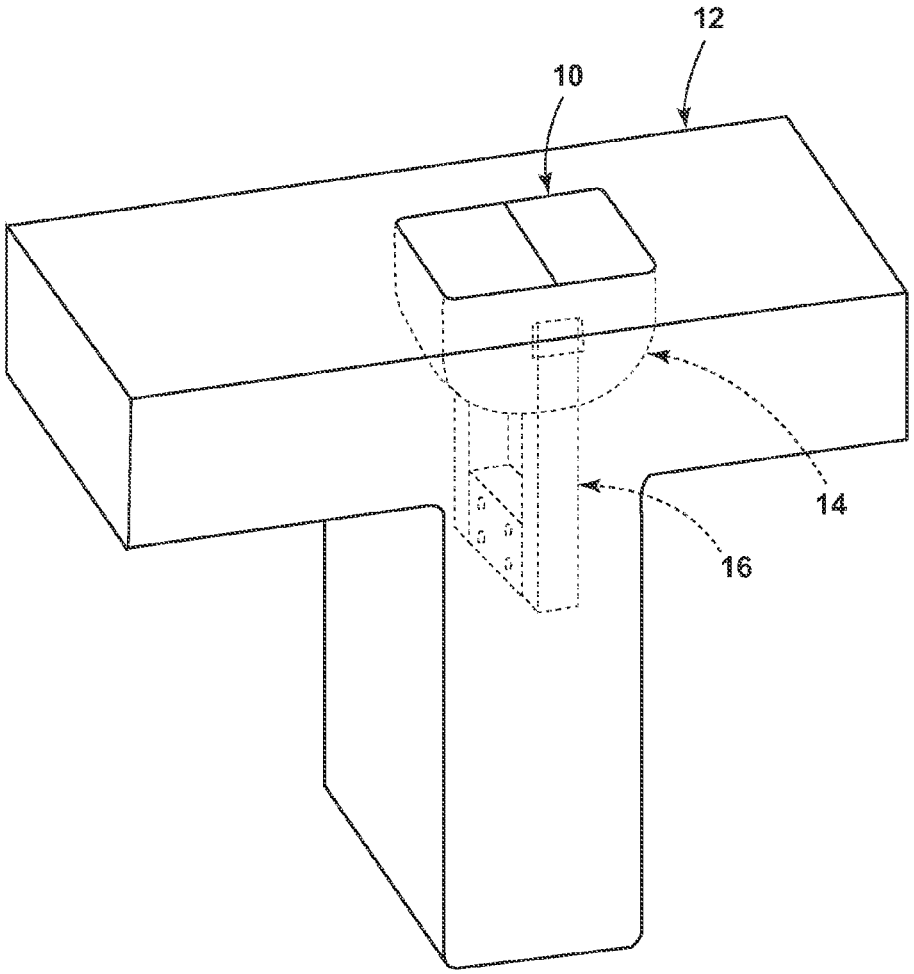
FIG. 1 is a perspective schematic view of a concrete lift anchor assembly comprising a recess insert and a lift anchor embedded in a prefabricated concrete tee according to an exemplary embodiment of the invention.

Referring to the drawings, and in particular to FIG. 1, an exemplary embodiment of a lift anchor assembly 10 according to the invention is illustrated embedded in a Portland cement concrete shape 12 in the form of a structural tee. The lift anchor assembly 10 includes a recess insert 14 and a lift anchor 16. As hereinafter described, the lift anchor assembly 10 can also include a shear bar.

Figure 2:
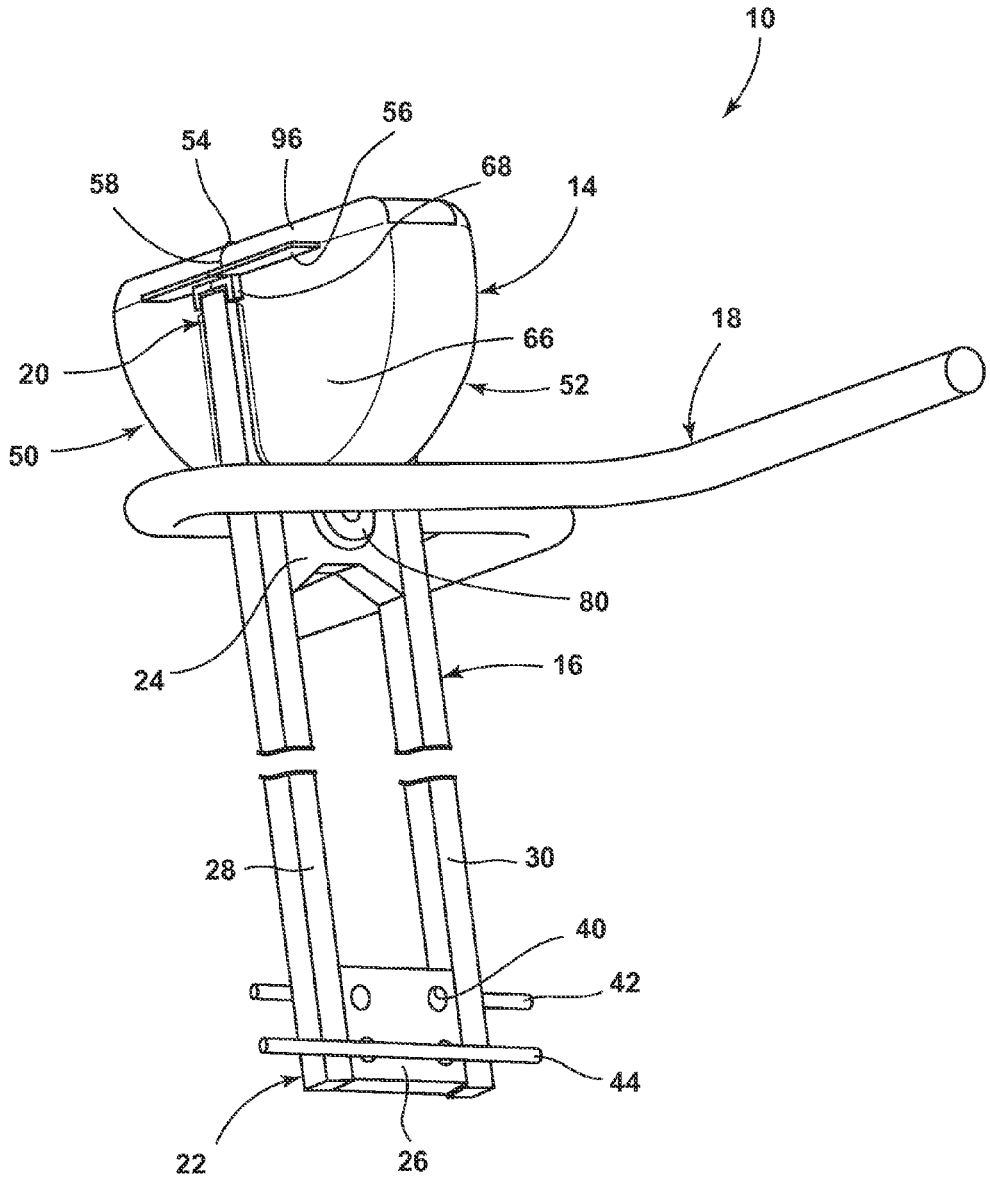
FIG. 2 is a perspective view of the concrete lift anchor assembly of FIG. 1 illustrating the recess insert, a first embodiment of the lift anchor, and a U-shaped shear bar.
Figure 3A:
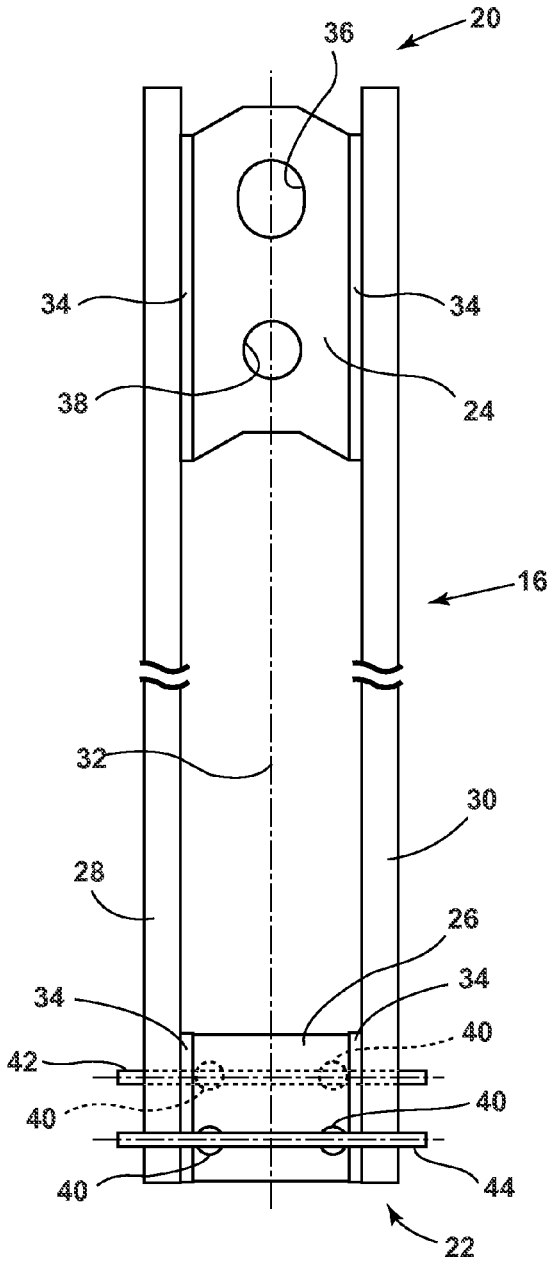
FIGS. 3A-B are elevation views from the front and side, respectively, of the lift anchor of FIG. 2.
Figure 3B:
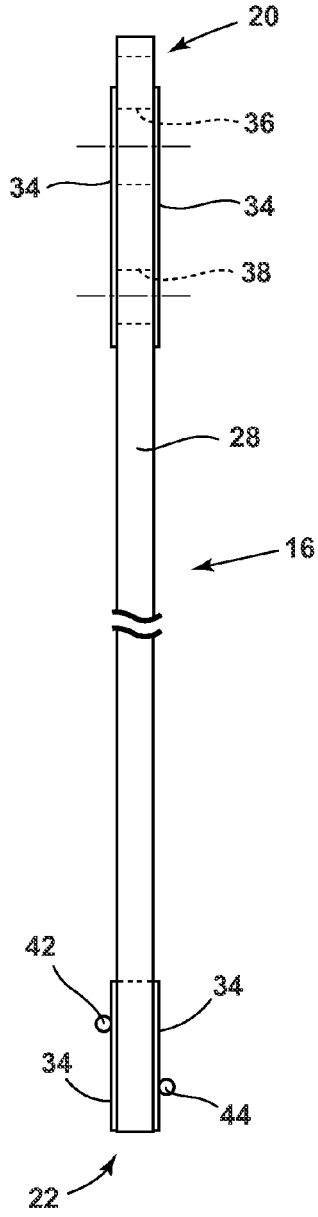

Turning now to FIG. 2, the recess insert 14, lift anchor 16, and shear bar 18 are shown in an assembled configuration. The recess insert 14 is coupled with the lift anchor 16, and the shear bar 18 is coupled with the recess insert 14 and, thus, the lift anchor 16, as described hereinafter. Referring also to FIGS. 3A and 3B, the lift anchor 16 is an elongate body characterized by a lift end 20, an embedment end 22, and a longitudinal axis 32. A pair of parallel spaced elongate legs 28, 30 may extend from the lift end 20 to the embedment end 22. A lift plate 24 may be a flattened body having a thickness generally commensurate with the cross-sectional dimensions of the legs 28, 30. The lift plate 24 may be characterized by a pair of parallel, spaced apart sidewalls (not shown), each side wall rigidly attached by weld lines 34 to a leg 28, 30 in coplanar disposition.

The embedment end 22 may comprise an embedment portion rigidly coupled with the legs 28, 30. For example, an embedment plate 26 may a flattened body having a thickness generally commensurate with the cross-sectional dimensions of the legs 28, 30 and the lift plate 24. The embedment plate 26 may be characterized by a pair of parallel, spaced apart sidewalls (not shown), each side wall rigidly attached by weld lines 34 to a leg 28, 30 in coplanar disposition. As illustrated in FIG. 3B, the assembled lift plate 24, embedment plate 26, and legs 28, 30 may form a planar assembly of generally uniform thickness.

In use, the lift anchor 16 may be placed in fresh Portland cement concrete so that the embedment end 22 is immersed in the concrete, and the lift end 20 is exposed within a cavity formed in the cured concrete.

The lift plate 24 may also be characterized by a through opening 36 bisected by the longitudinal axis 32, and which, for illustrative purposes, may be oval. The lift plate 24 may also be characterized by a circular through opening 38 bisected by the longitudinal axis 32. The through opening 36 may provide a means of connecting a lifting apparatus (not shown) to the lift anchor 16. The circular through opening 38 may facilitate attachment of the recess insert 14 to the lift anchor 16 as hereinafter described.

The recess insert 14 may be a hollow body having a clamshell configuration. Accordingly, the recess insert 14 may have a first insert shell 50 and a second insert shell 52 that are attached along a flexible hinge 54 or a similar rotatable joint. Each shell 50, 52 may be shaped as circular quadrant. Consequently, when the two insert shells 50, 52 are closed around the lift end 20 of the lift anchor 16, the two shells 50, 52 may define a semicircular profile. This semicircular profile corresponds to a cavity formed in the concrete shape 12 that exposes the lift end 20 of the lift anchor 16.

Figure 6:
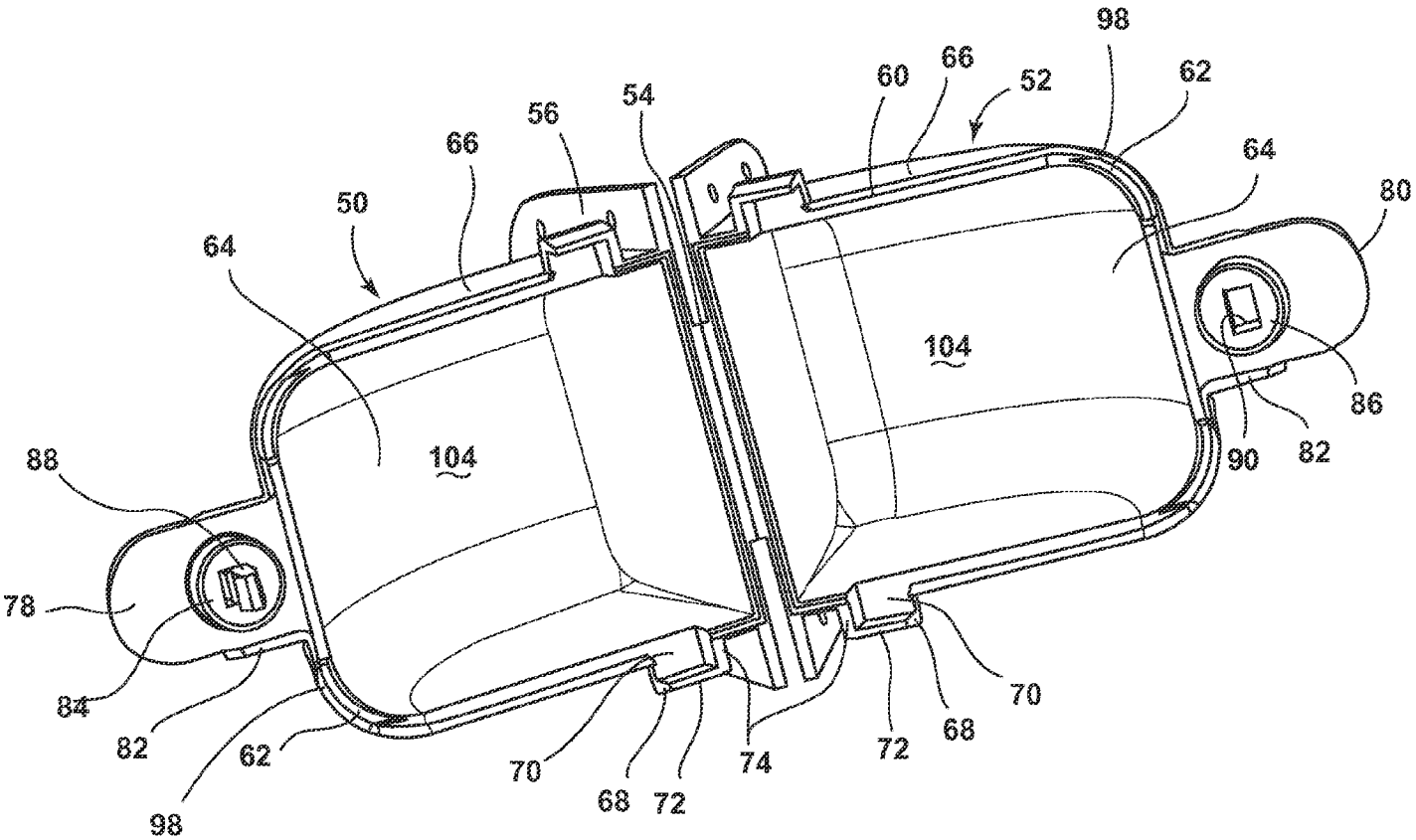
FIG. 6 is a perspective view of the recess insert of FIG. 5 in an opened configuration illustrating the interior of the recess insert and integrated functionalities.

Both the first insert shell 50 and the second insert shell 52 may have closure tabs 78, 80 extending radially from the curved wall 64 that may align when the insert shells 50, 52 are rotated about the flexible hinge 54 into the closed configuration 14. The closure tabs 78, 80 may include inwardly extending spacers 84, 86, respectively, that may come into contact when the insert shells 50, 52 are in the closed configuration 14. The first spacer 84 attached to the first closure tab 78 may include a cantilevered catch 88 extending orthogonally away from the tab 78. The second spacer 86 attached to the second closure tab 80 may include a catch opening 90, which may engage the catch 88 when the spacers 84, 86 are brought into contact. In FIG. 6, the cantilevered catch 88 is illustrated with a tooth that can be inserted through the catch opening 90 to hold the second spacer 86 against the first spacer 84.

Figure 4A:
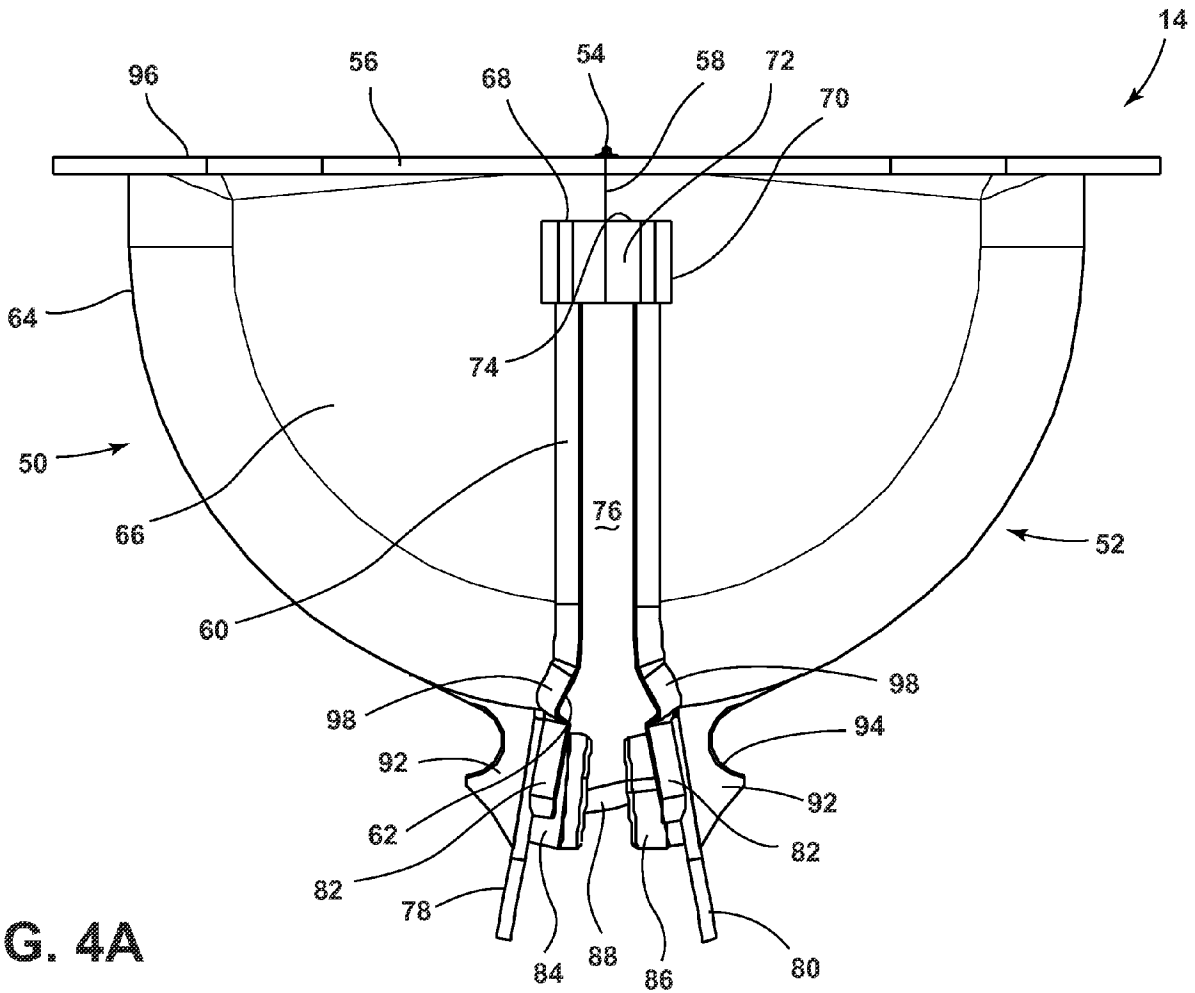
FIG. 4A is an elevation view from a side of a first embodiment of the recess insert of FIG. 2 illustrating integrated functionalities, including locking tabs in adjacent disposition, enabling coupling of the recess insert with the lift anchor.
Figure 4B:
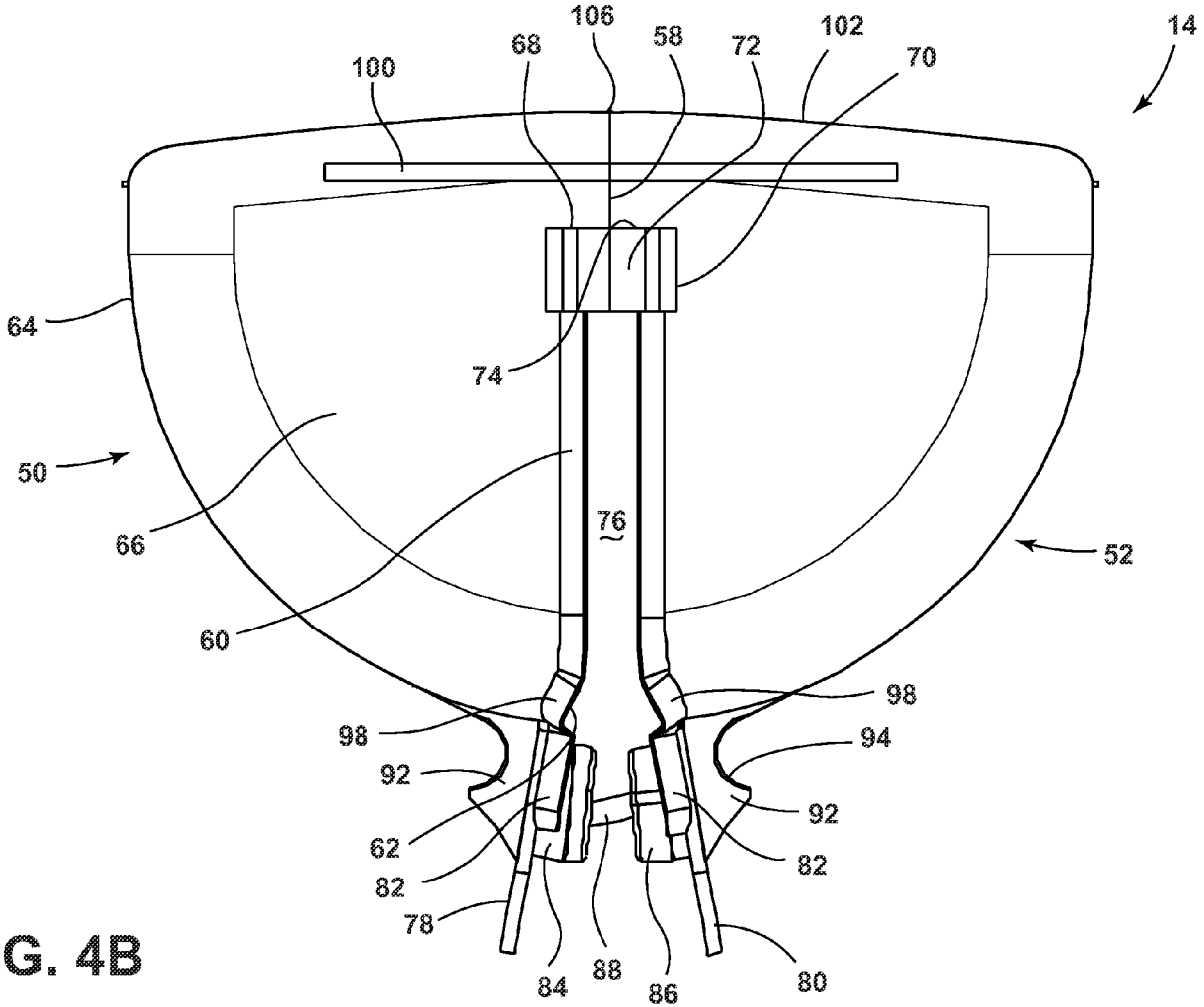
FIG. 4B is an elevation view from a side of a second embodiment of the recess insert of FIG. 2 illustrating integrated functionalities, including locking tabs in adjacent disposition, enabling coupling of the recess insert with the lift anchor.
Figure 5:
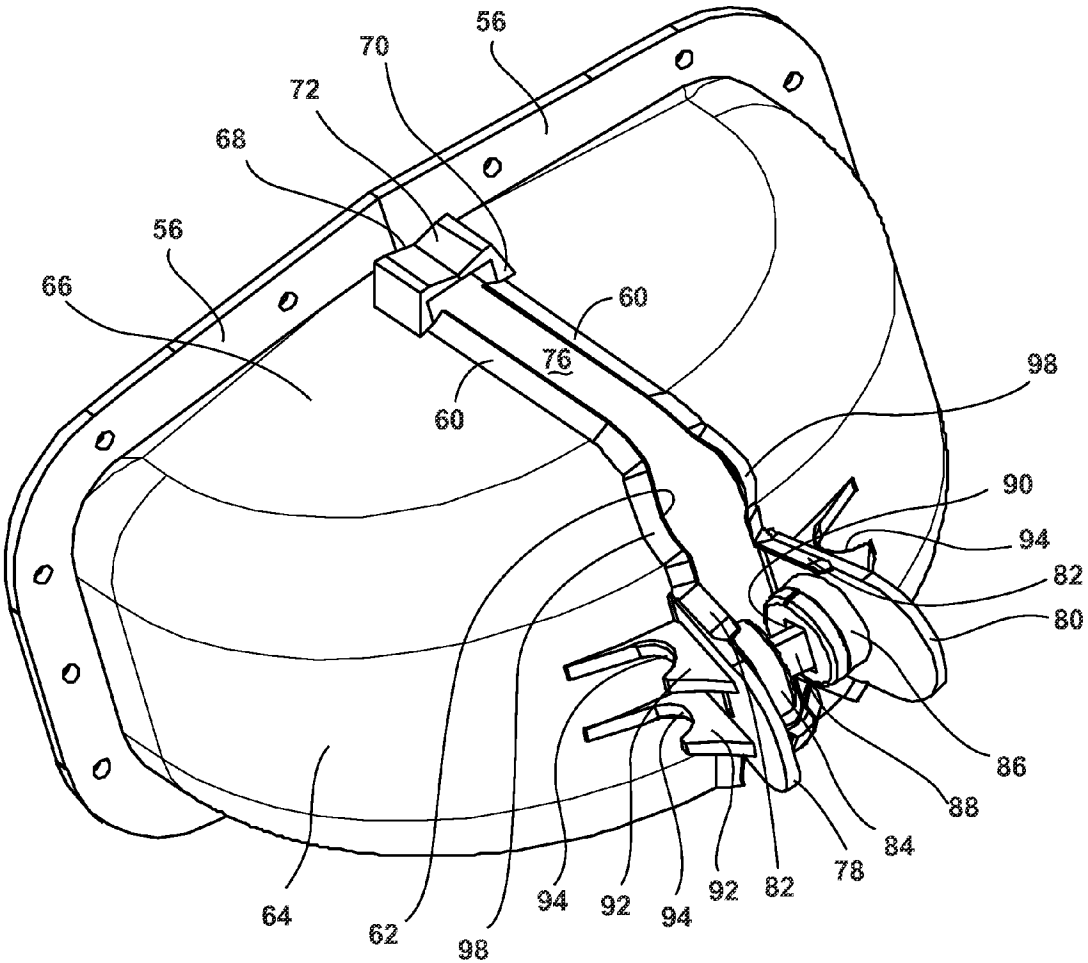
FIG. 5 is a perspective view of a third embodiment of the recess insert of FIG. 2 illustrating details of the locking tabs.

The insert shells 50, 52 may form a lift anchor seat 68 extending from the side walls 66. The lift anchor seat 68 may be a somewhat hollow rectangular structure having a pair of spacer walls 70 each extending generally orthogonally away from the side wall 66. The spacer wall 70 may transition orthogonally to an outer wall 72. When the insert shells 50, 52 are rotated into the configuration illustrated in FIGS. 4A, 4B, and 5, the walls 70, 72 may define a rectangular space. Referring also to FIG. 6, the spacer walls 70 and outer walls 72 may terminate in an orthogonal end wall 74 adjacent the flange 56.

An anchor slot 76 may extend away from the lift anchor seat 68 between the insert shells 50, 52. The anchor slot 76 may be bordered by an anchor skirt 60. The transition between the side walls 66 and the curved wall 64 may terminate at the anchor slot 76 in a somewhat concave weld opening 62 bordered by a weld opening skirt 98. With reference again to FIGS. 3A and 3B, the weld openings 62 may accommodate the weld bead 34 extending beyond the lift plate 24 and legs 28, 30. The closure tabs 78, 80 may be partially bordered by tab skirts 82 continuing from the weld opening skirts 98.

The lift anchor 16 may be coupled with the recess insert 14 so that the lift end 20 is received in the lift anchor seats 68 with the legs 28, 30 extending along the anchor slot 76. The skirts 60, 82, 98 may facilitate sealing of the recess insert 14 around the lift anchor 16.

Figure 8A:
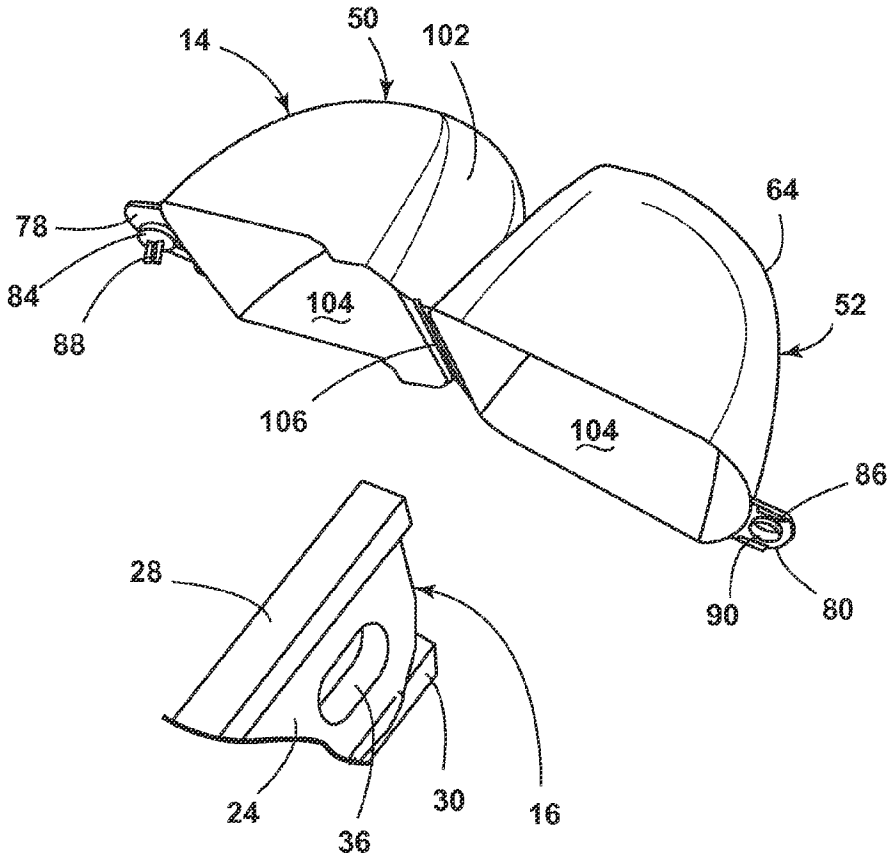
FIGS. 8A-D are perspective views of the recess insert of FIG. 4B, a portion of the lift anchor of FIG. 3A, and the shear bar of FIG. 2 illustrating sequential steps in the assembly of the concrete lift anchor assembly of FIG. 2.
Figure 8B:
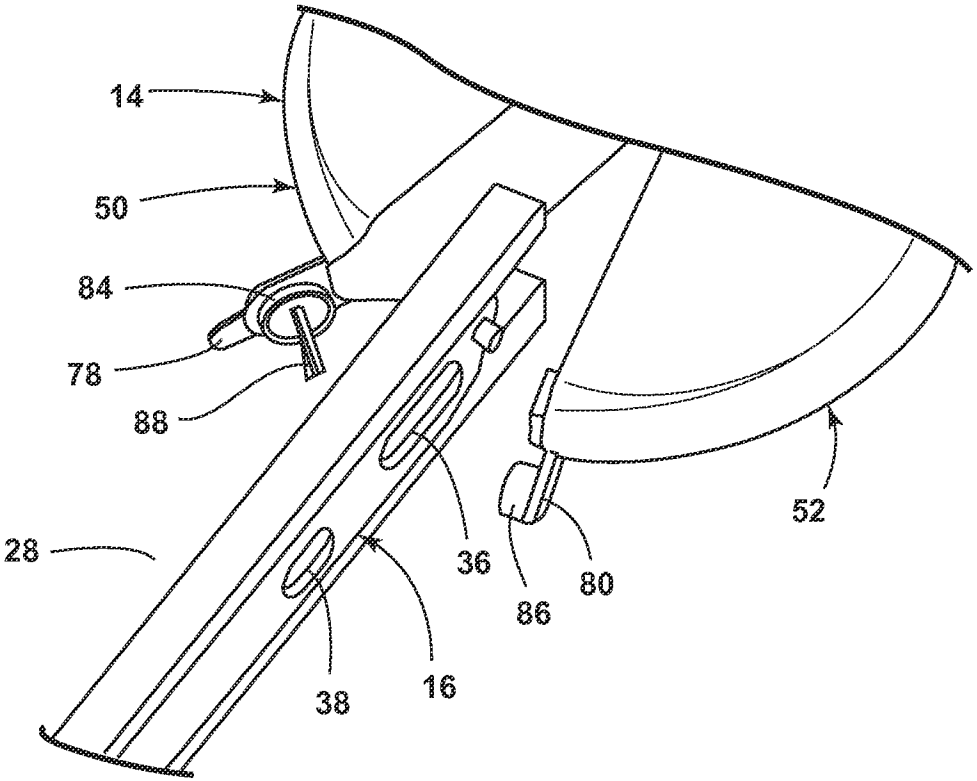
Figure 8C:
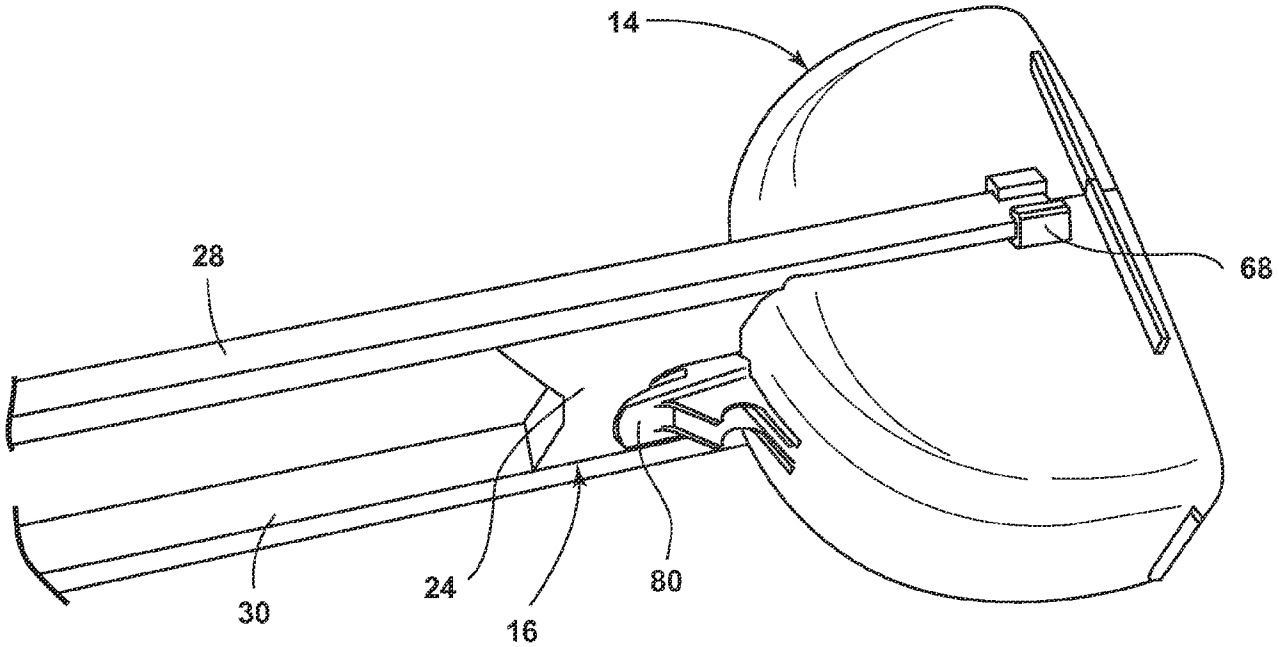

As illustrated in FIGS. 8A-C, as the insert shells 50, 52 are brought into a closed configuration, the closure tabs 78, 80 may be moved so that the spacers 84, 86 may approach one another. Movement of the closure tabs 78, 80 may continue until the spacers 84, 86 extend into the circular through opening 38 so that the cantilevered catch 88 engages the catch opening 90. The recess insert 14 will be held in a closed configuration over the lift end 20 of the lift anchor 16.

Figure 8D:
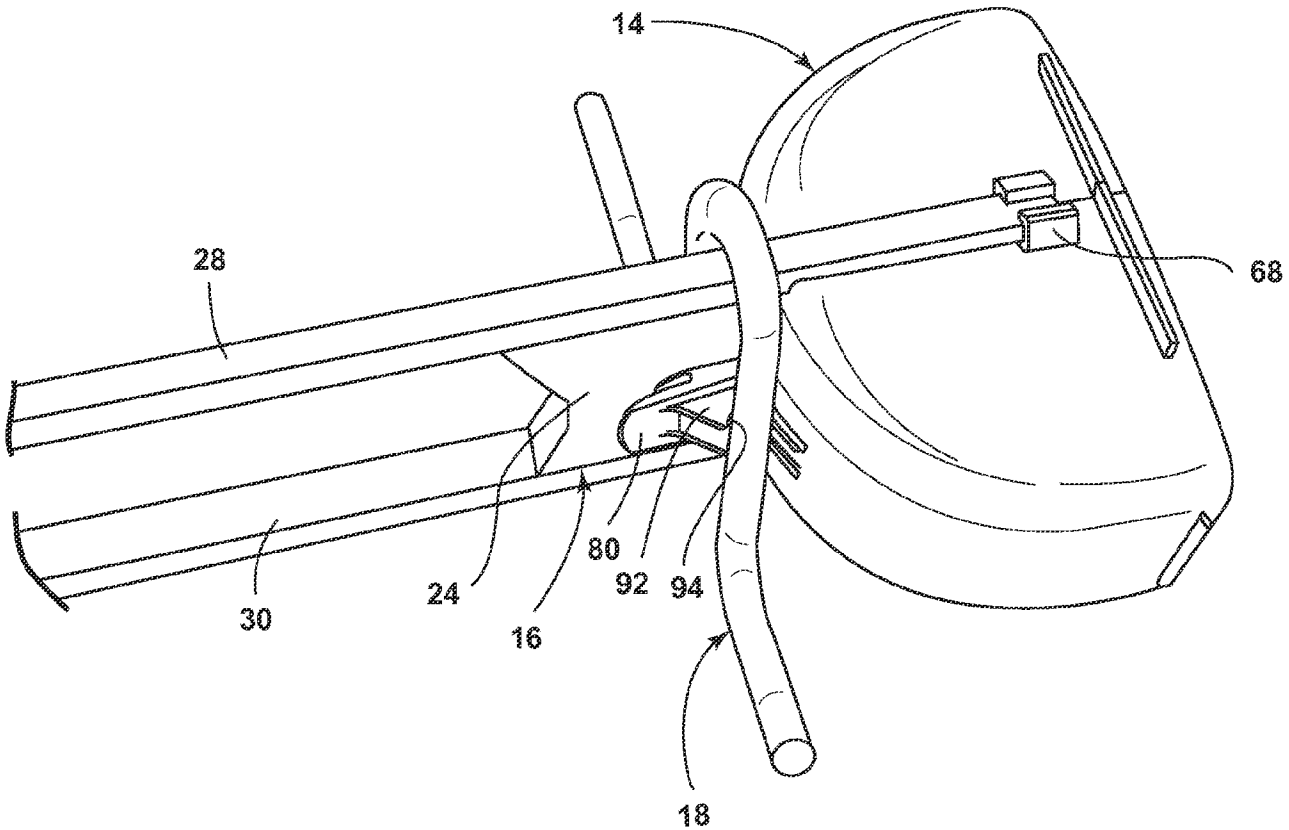

Referring again to FIGS. 4A, 4B, and 5, a tab buttress 92 may couple the outside face of a closure tab 78, 80 with the curved wall 64 to reinforce the closure tabs 78, 80 against flexure. Each tab buttress 92 may be configured to define a shear bar cradle 94. As illustrated in FIG. 8D, the shear bar 18 can be coupled to the recess insert 14 and lift anchor 16 by slidably engaging the shear bar cradles 94 with the first bight leg 116, and the second bight leg 118. The inflexibility of the bight section 114 may eliminate flexure of the bight legs 116, 118, thereby urging the closure tabs 78, 80 against the lift plate 24, and maintaining the recess insert 14 in a closed configuration around the lift end 20.

The engagement of the shear bar 18 with the shear bar cradles 94 may also minimize movement of the shear bar 18 relative to the recess insert 14 and the lift anchor 16. The recess insert 14, lift anchor 16, and shear bar 18 may be interlocked into a lift anchor assembly 10 that may resist movement during preparations for and placement of precast concrete.

Turning again to FIG. 4B, the recess insert 14 may alternatively include a top wall 102 that is inclined away from a hinge line 106 toward the curved walls 64. After curing of the concrete containing the lift anchor assembly 10, a force may be applied toward the lift anchor 16 along the hinge line 106 sufficient to depress and fracture the top wall 102. The top wall 102 can then be broken away, leaving a smooth arcuate cavity with a plastic lining.

Alternatively, a force may be applied toward the lift anchor 16 along the hinge line 106 sufficient to depress the top wall 102 along the hinge line 106 and thereby separate the insert shells 50, 52. Separation of the insert shells 50, 52 may be dependent upon removal of the closure tabs 78, 80 from the curved walls 64. With the insert shells separated, the insert 14 may be removed from the lift anchor 16, leaving a cavity surrounding the exposed lift end 20.

Figure 7:
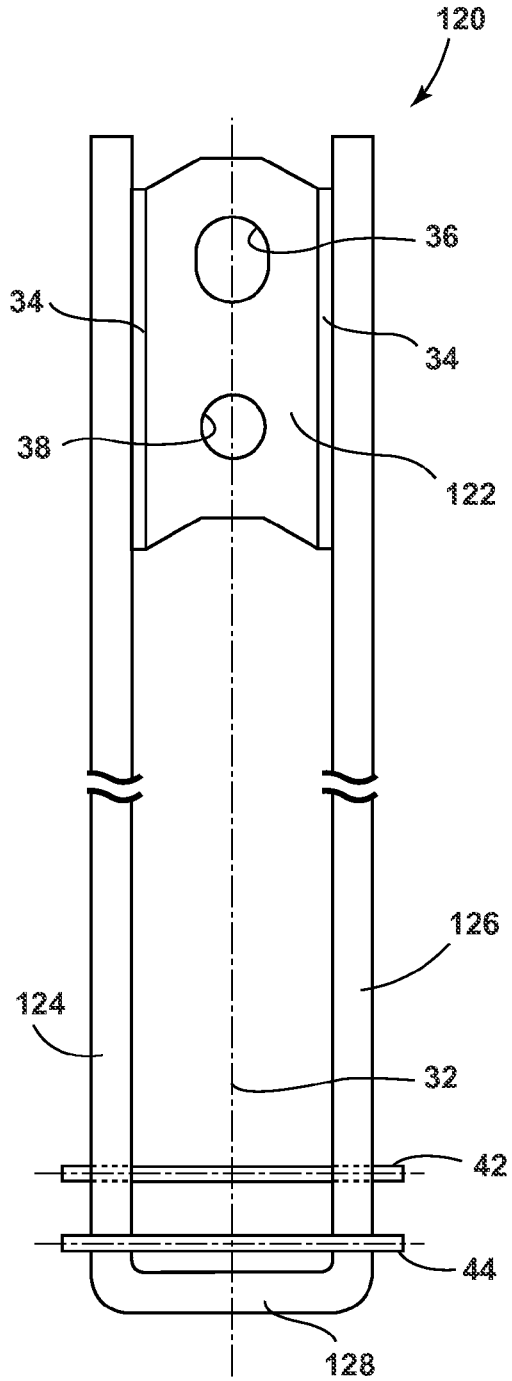
FIG. 7 is an elevation view of a second embodiment of the lift anchor illustrated in FIGS. 3A-B.

Turning now to FIG. 7, an exemplary second embodiment of the embedment portion of the lift anchor 120 is illustrated. The lift anchor 120 is identical to the lift anchor 16, except that the embedment end 22 comprises a transverse member 128 rather than the embedment plate 26. The transverse member 128 may be an orthogonal continuation of the legs 124, 126. Thus, the legs 124, 126 and transverse member 128 may be formed from a single length of metal rod, and bent 90° at two locations to form the transverse member 128 connecting the legs 124, 126. The parallel legs 124, 126 can then be attached to the lift plate 24 as previously described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A lift anchor assembly for precast Portland cement concrete shapes, the lift anchor assembly comprising:

a plate-like lift anchor characterized by a lift end and an embedment end, and defining a longitudinal axis, the lift end including a bilaterally symmetrical lift plate characterized by a through-opening, the embedment end including a bilaterally symmetrical embedment portion spaced away from the lift end and coupled with the lift plate, and a pair of elongate legs parallel to the longitudinal axis, each leg coupled with the embedment portion, and with the lift plate;

a recess insert characterized by a pair of concave insert shells coupled together by a pivotable coupling, each insert shell including a curved wall having a tabbed end, each tabbed end comprising a tab reinforcer including a shear bar retainer and a projection, the projections joinable by rotation of the insert shells together about the pivotable coupling; and an elongate rod-like shear bar characterized by a U-shaped bend comprising a pair of spaced-apart parallel bight legs;

wherein the insert shells are positionable on either side of the lift end and rotatable about the pivotable coupling to a closed configuration so that the projections extend into, and are joined in, the through-opening to fixedly retain the recess insert in a predetermined position over the lift end;

wherein the shear bar is fixedly coupleable with the recess insert by slidably engaging the bight legs with the shear bar retainers;

wherein the recess insert is fixedly coupleable with the lift anchor by the insertion of the projections into the through-opening;

wherein separation of the projections from the through-opening and separation of the insert shells from the lift anchor are controllable by the coupling of the shear bar to the shear bar retainers;

wherein movement of the shear bar relative to the recess insert and the lift anchor is controllable by the engagement of the shear bar with the shear bar retainers; and wherein the recess insert, the lift anchor, and the shear bar are interlockable into a lift anchor assembly resistant to movement during preparations for and placement of precast Portland cement concrete.

2. A lift anchor assembly in accordance with claim 1 wherein the insert shells are rotatable about the pivotable coupling to join the tabbed ends of the curved walls and define a semicircular recess insert.

3. A lift anchor assembly in accordance with claim 1 wherein the lift anchor is held stationary with the recess insert by seating an end of each bight leg in a shear bar retainer.

4. A lift anchor assembly for precast Portland cement concrete shapes, the lift anchor assembly comprising:

a plate-like planar lift anchor characterized by a lift end and an embedment end, and defining a longitudinal axis, the lift end including a bilaterally symmetrical lift plate characterized by a through-opening, the embedment end including a bilaterally symmetrical embedment portion spaced away from the lift end and coupled with the lift plate, and a pair of elongate legs, each leg coupled with the embedment portion, and with the lift plate parallel to the longitudinal axis;

a recess insert characterized by a pair of concave insert shells, each insert shell including a curved wall having a tabbed end, the insert shells coupled together with a pivotable coupling to define a chamber, the tabbed ends of the curved walls joinable by rotation of the insert shells about the pivotable coupling to define a semicircular recess insert, each tabbed end including a tab and tab reinforcer extending radially from the tabbed end, and each tab reinforcer including a shear bar retainer and a projection, the projections joinable by rotation of the insert shells about the pivotable coupling; and an elongate rod-like shear bar characterized by a U-shaped bend;

wherein the recess insert is engageable with the lift end of the lift anchor by coupling the insert shells on either side of the lift anchor through the through-opening; and wherein the shear bar is engageable with the lift anchor and recess insert by positioning the U-shaped bend over the lift plate and the through-opening.

5. A lift anchor assembly in accordance with claim 4 wherein the lift plate additionally comprises an oval through opening bisected by the longitudinal axis.

6. A lift anchor assembly in accordance with claim 4 wherein the embedment portion comprises one of an embedment plate and a rod-like transverse member.

7. A lift anchor assembly in accordance with claim 6 wherein the transverse member is an orthogonally disposed continuation of the legs.

8. A lift anchor assembly in accordance with claim 4 wherein each concave insert shell defines a sector of a circle.

9. A lift anchor assembly in accordance with claim 4 wherein the tab reinforcers can be disposed to join the projections by inserting the projections into the lift plate through-opening and holding the lift anchor between the tab reinforcers.

10. A lift anchor assembly in accordance with claim 9 wherein the U-shaped bend includes a curved section transitioning to a first leg and a second leg in parallel spaced-apart disposition with the first leg.

11. A lift anchor assembly in accordance with claim 10 wherein the projections can remain joined by slidably seating each leg of the U-shaped bend with a shear bar retainer to urge the tab reinforcers together.

12. A kit for lifting precast Portland cement concrete shapes, the kit comprising:

a lift anchor comprising a lift plate having a through-opening and characterized by a lift end, and an embedment end embeddable in Portland cement concrete;

a pair of insert shells coupled together with a pivotable coupling, each having a curved wall terminating in a tabbed end including a tab reinforcer comprising a shear bar retainer and a projection, the insert shells engageable with the lift anchor lift end by rotating the insert shells about the pivotable coupling to move the closure tabs toward one another, join the projections through the through-opening, position the shear bar retainers on opposite sides of the through-opening, and fix the lift anchor in a predetermined position; and an elongate rod-like shear bar characterized by a U-shaped bend comprising an inflexible bight section transitioning to a pair of parallel bight legs, to enable fixed coupling of the shear bar with the recess insert and lift anchor by slidably engaging the bight legs with the shear bar retainers to thereby hold the tabbed ends against the lift plate, and join the projections together.

* * * * *